US006955114B2

(12) United States Patent
Stockner et al.

(10) Patent No.: US 6,955,114 B2
(45) Date of Patent: Oct. 18, 2005

(54) THREE WAY VALVE AND ELECTRO-HYDRAULIC ACTUATOR USING SAME

(75) Inventors: Alan R. Stockner, Metamora, IL (US); Norval J. Wiemken, Dwight, IL (US); Scott F. Shafer, Morton, IL (US); Gene R. Slinkard, Pontiac, IL (US); Mark S. Cavanagh, Bloomington, IL (US); Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/729,539

(22) Filed: Dec. 5, 2003

(65) Prior Publication Data

US 2005/0120872 A1 Jun. 9, 2005

(51) Int. Cl.[7] ..... F15B 13/044
(52) U.S. Cl. ..... 91/417 R; 137/625.65
(58) Field of Search ..... 91/417 R; 137/625.65

(56) References Cited

U.S. PATENT DOCUMENTS

| | | | | |
|---|---|---|---|---|
| 5,125,575 | A | 6/1992 | Iwanaga | |
| 5,429,154 | A | 7/1995 | Kato | |
| 5,518,030 | A | 5/1996 | Liu et al. | |
| 5,575,311 | A | 11/1996 | Kingsford | |
| 5,669,355 | A | 9/1997 | Gibson et al. | |
| 6,024,296 | A | 2/2000 | Wear et al. | |
| 6,776,190 | B2 * | 8/2004 | Schoepke et al. | 137/625.65 |
| 2004/0007210 | A1 * | 1/2004 | Tian et al. | 123/456 |
| 2004/0021016 | A1 * | 2/2004 | Wiemken et al. | 239/585.1 |
| 2004/0124272 | A1 * | 7/2004 | Yacoub et al. | 239/533.2 |
| 2004/0195348 | A1 * | 10/2004 | Lewis et al. | 239/88 |

FOREIGN PATENT DOCUMENTS

| | | | |
|---|---|---|---|
| JP | 01012180 | A | 1/1989 |
| JP | 02009944 | A | 1/1990 |

* cited by examiner

*Primary Examiner*—Gerald A. Michalsky
(74) *Attorney, Agent, or Firm*—Liell & McNeil

(57) ABSTRACT

The present invention relates to high speed control valves which are especially applicable for use in fuel injection systems. Producing a valve with a quick response time within acceptable packaging constraints and with a structure that allows the valve to be mass produced with consistent performance between valves is extremely problematic. By moving flow restrictions within the valve away from the valve seats, flow forces on the valve member can be reduced, while possibly also permitting a reduction in the necessary travel distance of the valve member to improve response time and other performance characteristics. The valve is particularly applicable in controlling hydraulic pressure applied to the closing hydraulic surface of a direct control needle valve in a fuel injector.

33 Claims, 7 Drawing Sheets

18
19
20
21
22
17
16
10
12
42
40
14
41
39
37
33
32
36
24
31
35
11
30
34
25
23

THREE WAY VALVE AND ELECTRO-HYDRAULIC ACTUATOR USING SAME

TECHNICAL FIELD

The present invention relates generally to high speed liquid valves with a small flow volume, and more particularly to a three way control valve for use in an electro-hydraulic actuator, such as a portion of a fuel injector.

BACKGROUND

Electro-hydraulic actuators, such as those used in conjunction with fuel injectors having a direct control needle valve, rely upon relatively small and fast valves in order to control fuel injection characteristics. In one class of fuel injection systems, a direct control needle valve opens and closes the nozzle outlet of the fuel injector. The direct control needle valve is controlled hydraulically via a relatively high speed needle control valve that has the ability to apply either low pressure or high pressure to a closing hydraulic surface associated with the direct control needle valve. One such direct control needle valve and accompanying needle control valve is disclosed in co-owned U.S. Pat. No. 5,669,355 to Gibson et al. That reference teaches a fuel injector that includes a needle control valve with the ability to apply high pressure or low pressure oil to a closing hydraulic surface of a direct control needle valve. When high pressure is applied to the closing hydraulic surface, the needle valve stays in, or moves toward, its closed position to end the spray of fuel. When low pressure is applied to the closing hydraulic surface, and the fuel is at injection pressure levels, the needle valve will stay in, or move toward, its open position to allow fuel to spray out of the nozzle outlets of the fuel injector. In order to accomplish various goals, such as reducing undesirable emissions from an engine, engineers are constantly seeking ways of improving performance of direct control needle valves, especially by addressing problems associated with needle control valves.

One of the problems that could be addressed in improving a needle control valve is to reduce response time. This problem can then be broken down into seeking ways to reduce the valve member's travel distance, increasing the travel speed and/or acceleration of the valve member, decreasing the influence of fluid flow forces on valve member movement, and other issues known in the art. In addition, it is desirable to employ strategies that hasten the rate at which pressure changes can occur within the needle control chamber that applies the hydraulic force to the closing hydraulic surface of the needle valve member. These problems are further compounded by issues relating to an available space envelope for the valve, and maybe more importantly the ability to address all of these problems with a structure that allows for the valve to be mass produced with consistent behavior from one valve to another. Still another problem that could be addressed relates to efficiency. For instance, reducing leakage through the valve can make a difference in the overall viability of a given valve.

The present invention is directed to one or more of the problems set forth above.

SUMMARY OF THE INVENTION

In one aspect, a three way control valve includes a valve body with a first passage, a second passage, a third passage, a first seat and a second seat. A valve member is at least partially positioned in the valve body and movable between the first seat and the second seat. The first passage is open to the third passage across the first seat when the valve member is in contact with the second seat. One of the first passage and the third passage has a flow restriction relative to the flow area across the first seat. The second passage is open to the third passage across the second seat when the valve member is in contact with the first seat. One of the second passage and the third passage has a second flow restriction relative to a flow area across the second seat.

In another aspect, an electro-hydraulic actuator includes a three way control valve with a closed control pressure volume, with a control passage a high pressure passage fluidly connected to a source of high pressure liquid, and a low pressure passage fluidly connected to a low pressure liquid reservoir. The three way control valve includes a valve member trapped to move between a high pressure seat and a low pressure seat. A movable piston with a control hydraulic surface is exposed to fluid pressure in the control pressure volume. An electrical actuator is operably coupled to the valve member. The low pressure passage is open to the control passage across the low pressure seat when the valve member is in contact with the high pressure seat. One of the low pressure passage and the control passage has a first flow restriction relative to a flow area across the low pressure seat. The high pressure passage is open to the control passage across the high pressure seat when the valve member is in contact with the low pressure seat. One of the high pressure passage and the control passage has a second flow restriction relative to a flow area across the high pressure seat.

In still another aspect, a method of operating a three way control valve includes a step of fluidly connecting a first passage to a third passage across a first valve seat at least in part by positioning a valve member in contact with a second seat. Liquid flow from the third passage to the first passage is restricted at least in part by locating a first flow restriction in one of the first passage and the control passage, wherein the first flow restriction is restrictive relative to a flow area across the first seat. The second passage is fluidly connected to the third passage across an second seat at least in part by moving the valve member into contact with the first seat. Liquid flow from the second passage to the third passage is restricted at least in part by locating a second flow restriction in one of the second passage and the control passage, wherein the second flow restriction is restrictive relative to a flow area across the second seat.

DETAILED DESCRIPTION

Figure 1:
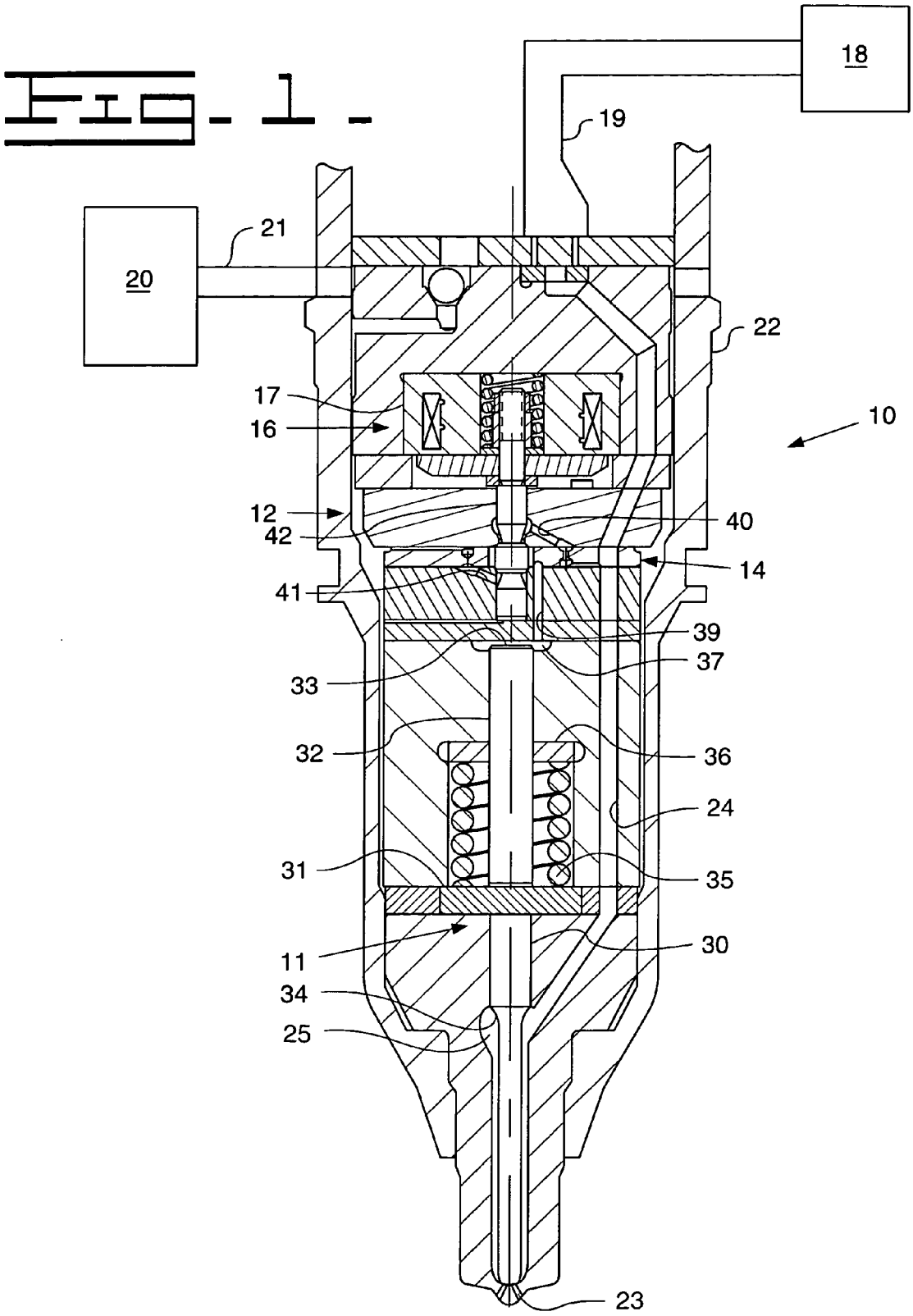
FIG. 1 is a sectioned side diagrammatic view of a fuel injector according to one aspect of the present invention.

Referring to FIG. 1, a fuel injector 10 includes a direct control needle valve 11 that is operably coupled to an electro-hydraulic actuator 12. Electro-hydraulic actuator 12 includes a three way valve 14 that is operably coupled to an electrical actuator 16. Fuel injector 10 is connected to a source of high pressure fuel 18 via a fuel supply line 19, and connected to a low pressure fuel reservoir 20 via a fuel transfer passage 21. Those skilled in the art will recognize that the source of high pressure fuel 18 can come from a common rail, a fuel pressurization chamber within a unit injector or any other means known in the art for pressurizing fuel to injection levels. In addition, the injector body 22 includes at least one nozzle outlet 23.

Within fuel injector 10, fuel arriving from high pressure fuel source 18 travels through an unobstructed nozzle supply passage 24 to arrive at a nozzle chamber 25, which is shown blocked from fluid communication with nozzle outlet 23 by a needle portion 30 of direct control needle valve 11. Needle portion 30 includes an opening hydraulic surface 34 exposed to fluid pressure in nozzle chamber 25. Direct control needle valve 11 is normally biased downward to its closed position, as shown, by the action of a biasing spring 35 acting on a lift spacer 31, which is in contact with a top surface of needle portion 30. Direct control needle valve 11 also includes a piston portion 32 with a closing hydraulic surface 33 exposed to fluid pressure in a needle control chamber 37. Opening hydraulic surface 34 is in opposition to closing hydraulic surface 33. When three way valve 14 is in a first position, needle control chamber 37 is fluidly connected to source of high pressure fuel 18 via a high pressure passage 40 that connects at one end into nozzle supply passage 24. When valve 14 is at its second position, needle control chamber 37 is fluidly connected to low pressure reservoir 20 via a low pressure passage 41. Three way valve 14 is moved between its first position and its second position by energizing and deenergizing electrical actuator 16. When high pressure exists in needle control chamber 37, direct control needle valve 11 will stay in, or move toward, its downward closed position, as shown. When needle control chamber 37 is connected to low pressure, direct control needle valve 11 will lift to its upward open position if fuel pressure acting on opening hydraulic surface 34 is above a valve opening pressure, which is preferably determined by a biaser, such as the preload of biasing spring 35. In practice, the valve opening pressure of direct control needle valve 11 is adjusted by choosing a VOP spacer 36 of an appropriate thickness. In addition, the lift distance of direct control needle valve 11 is controlled by choosing an appropriate thickness for lift spacer 31. Those skilled in the art will appreciate that in the disclosed embodiment, needle control chamber is a closed volume.

Figure 2:
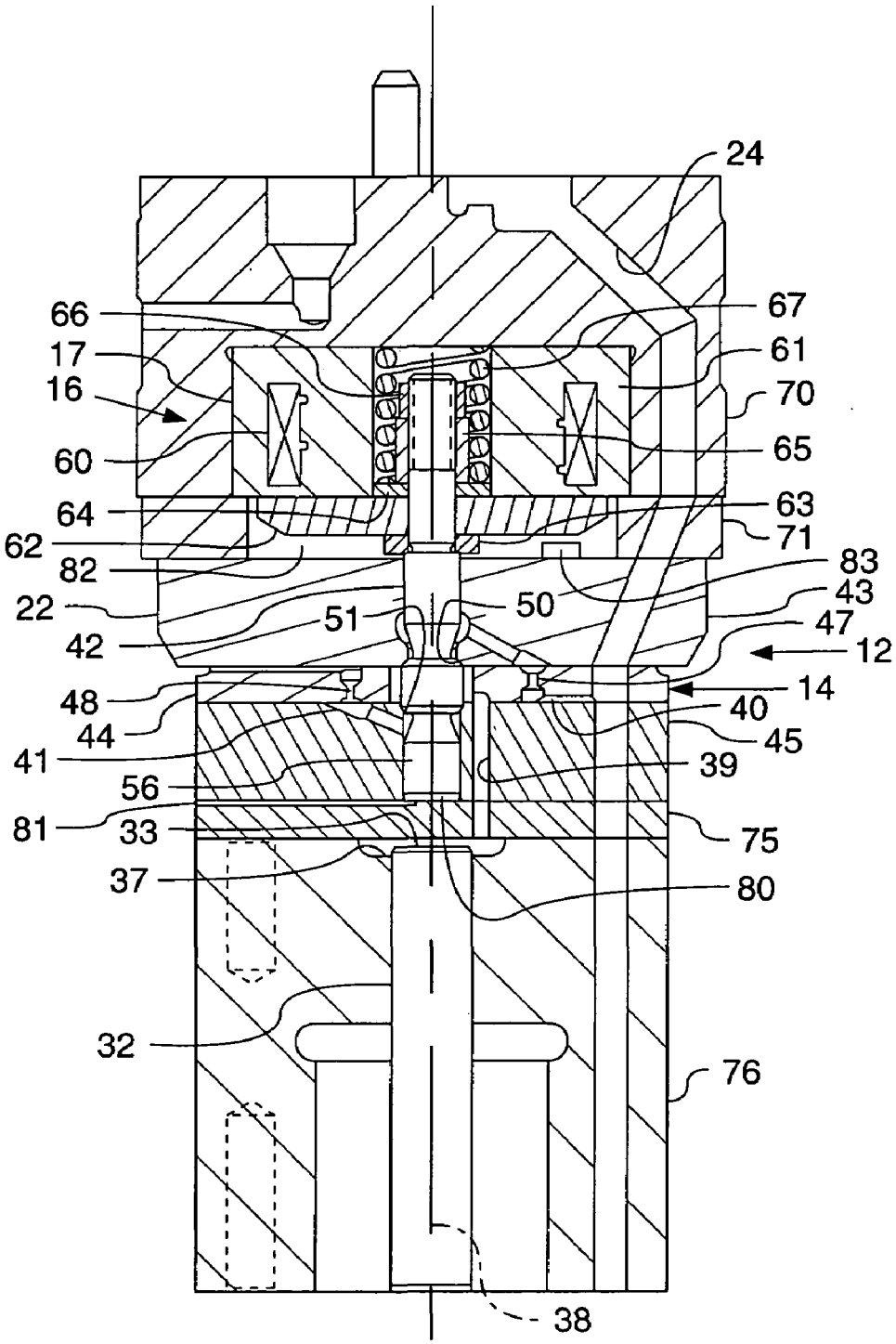
FIG. 2 is a sectioned side diagrammatic view of an electro-hydraulic actuator portion of the fuel injector shown in FIG. 1.
Figure 3:
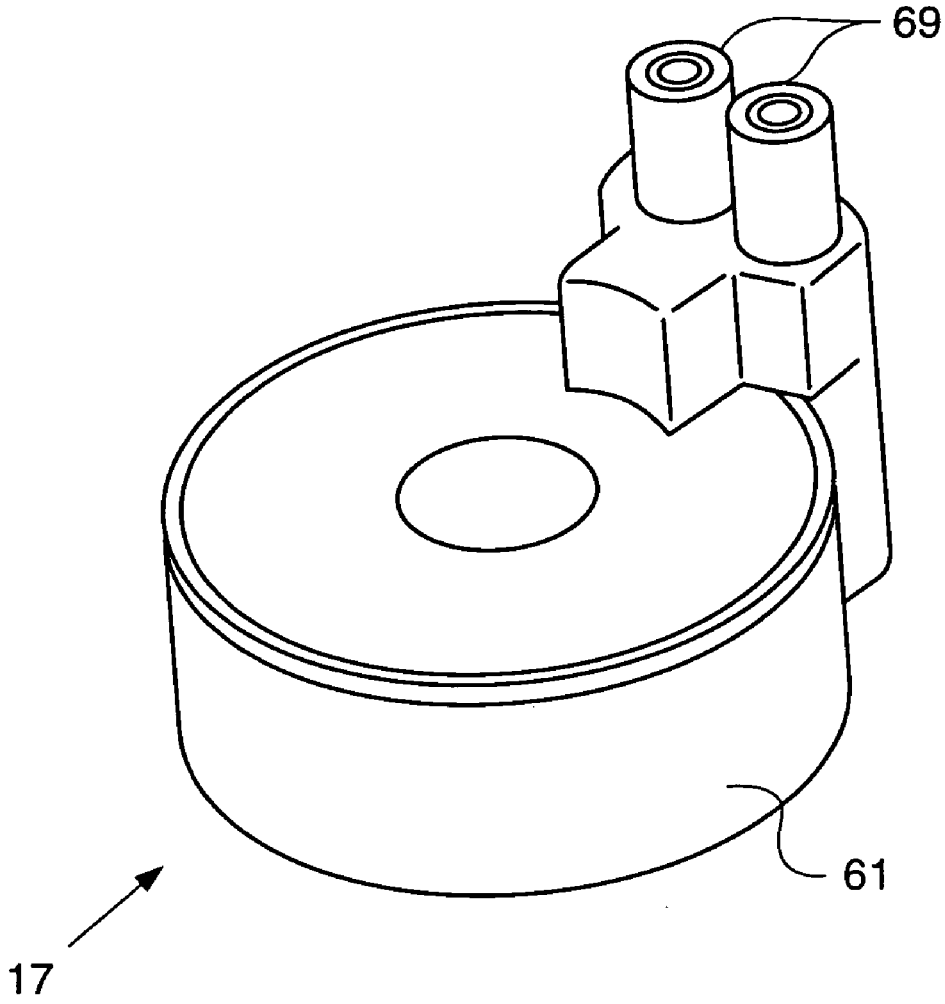
FIG. 3 is an isometric view of a solenoid stator assembly according to an aspect of the present invention.
Figure 4:
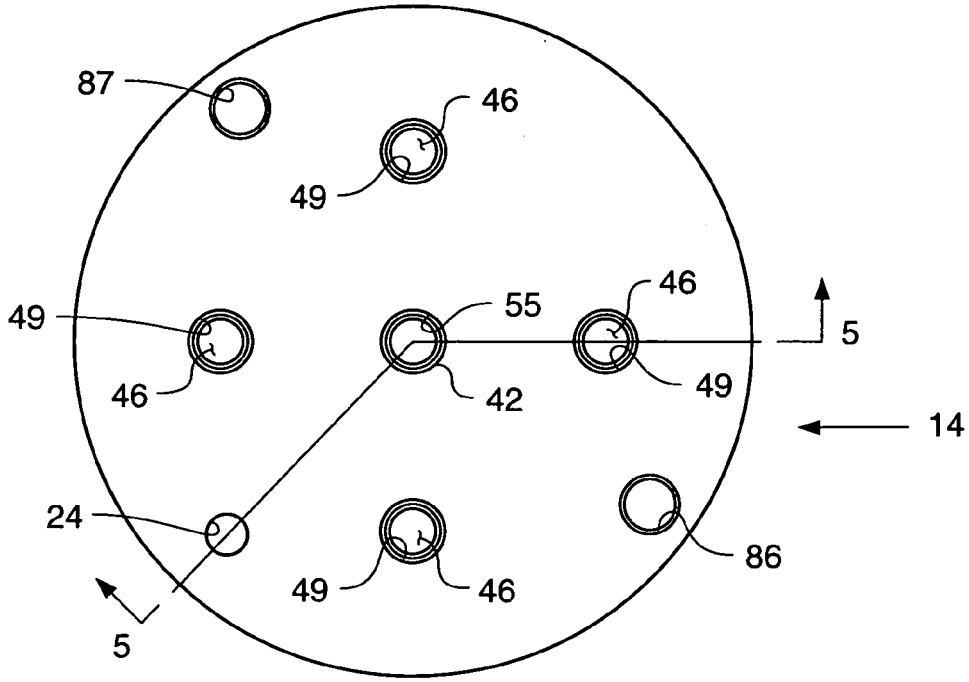
FIG. 4 is a top diagrammatic view of a three way valve portion of the electro-hydraulic actuator shown in FIG. 2.
Figure 5:
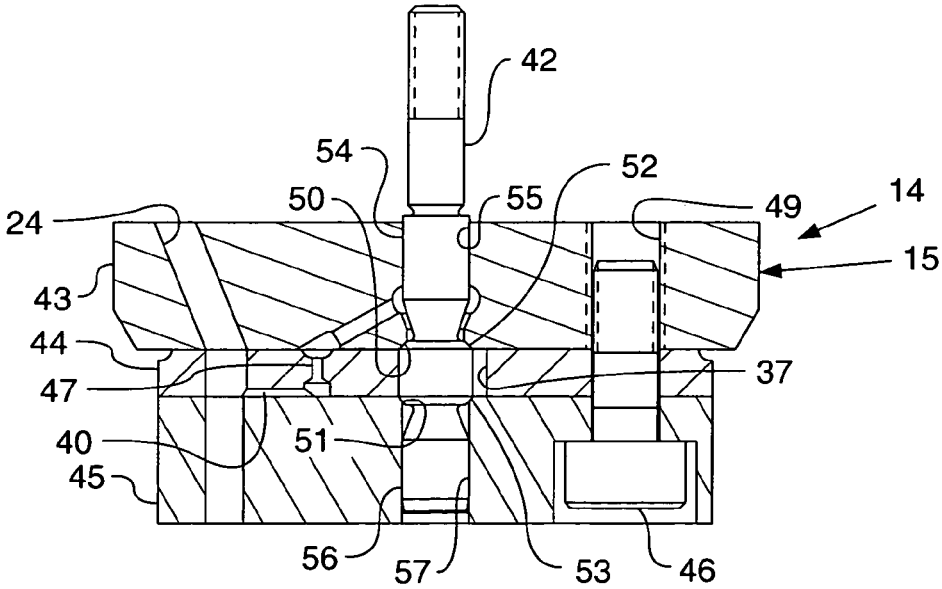
FIG. 5 is a sectioned side diagrammatic view of the three way valve shown in FIG. 4 as viewed along section lines 5—5.

Referring to FIG. 2, electro-hydraulic actuator 12 is shown apart from the fuel injector of FIG. 1. In addition, FIGS. 3–6 show the stator assembly, three way valve assembly and valve member respectively, that make up portions of electro-hydraulic actuator 12. Three way control valve 14 is preferably positioned in close proximity to piston portion 32 so that the volume of needle control chamber 37 is made relatively small. Those skilled in the art will appreciate that pressure changes in needle control chamber 37 can be hastened by reducing its volume. This issue is addressed by actuator 12 in at least two ways. First, three way valve 14 is positioned in close proximity to the closing hydraulic surface 33 of piston portion 32. In addition, needle control chamber 37 is preferably designed to be defined at least in part by volume reducing surface features. Thus, those skilled in the art will recognize that some measurable amount of improved performance can be achieved by paying attention to what surface features which define needle control chamber, can be changed in order to reduce the volume of needle control chamber 37 without otherwise undermining performance. In most instance, it will be desirable to make any flow areas associated with needle control chamber 37 less restrictive than the flow areas associated with high pressure passage 40, low pressure passage 41, or the flow areas across seats 50 and 51. When valve member 42 is in contact with lower seat 51, as shown, needle control chamber 37 is fluidly connected across high pressure seat 50 to nozzle supply passage 24 via high pressure passage 40. When valve member 42 is lifted upward into contact with high pressure seat 50, needle control chamber 37 is fluidly connected to a low pressure area that surrounds actuator 12 across low pressure seat 51 via low pressure passage 41. Thus, valve member 42 can be thought of as being trapped between upper seat 50 and lower seat 51. Seats 50 and 51 can also be referred to as first and second seats, or vice versa. In order to reduce the influence of hydraulic forces on opposite ends of valve member 42, a vent passage 83 vents armature cavity 82 to low pressure, and a vent passage 81 connects vented chamber 80 to low pressure.

Valve member 42 is preferably operably coupled in a known manner to the moveable portion of an electrical actuator. In the illustrated embodiment, valve member 42 is attached to an armature 62 via a nut 63 that is threaded onto one end of valve member 42. In particular, an armature washer 63 rests upon an annular shoulder 58 (FIG. 6), upon which armature 62 is supported. Next, a nut washer 64 is placed in contact with the other side of armature 62 followed by a spacer 65, against which nut 66 bears. Armature 62 and hence valve member 42 are biased downward to close low pressure seat 51 by a suitable biaser, such as biasing spring 67. Those skilled in the art will appreciate that a hydraulically biaser could be an alternative to the mechanical bias shown. In addition, while electrical actuator 16 has been shown as a solenoid, those skilled in the art will appreciate that any other suitable electrical actuator, such as a piezo (disks and/or a bender) or a voice coil could be substituted in its place. A stator assembly 17 includes a stator 61, a coil 60 and preferably includes a female/male electrical socket connector 69. Stator assembly 17 is preferably positioned within a carrier assembly 70 such that there respective bottom surfaces lie in a common plane. By doing so, a solenoid spacer 71 having an appropriate thickness can be chosen to provide a desired air gap between armature 62 and stator 61. Thus, solenoid spacer 71 is preferably a categorized part that comes in variety of slightly different thicknesses that allow different valves to perform similarly by choosing an appropriate thickness to provide uniformity in the armature air gap from one actuator to another.

In order to aid in concentrically aligning upper seat 50 with lower seat 51 along common centerline 38, valve member 42 includes an upper guide portion 54 with a close diametrical clearance (i.e. a guide clearance) with an upper guide bore 55 located in upper seat component 43. In addition, valve member 42 also preferably includes a lower guide portion 56 having a relatively close diametrical clearance with a lower guide bore 57 located in lower seat component 45. Thus, these guide regions tend to aid in concentrically aligning upper and lower seats 50 and 51 during the assembly of three way valve 15 (FIG. 5) as well as substantially fluidly isolating needle control chamber 37 from vented chamber 80 and/or armature cavity 82, regardless of the position of valve member 42. Because it is difficult to be certain, before assembly, the depth into seats 50 and 51 that valve member 42 will penetrate before coming in contact in closing that particular seat, three way valve 15 preferably employs a valve lift spacer 44 that is also a category part, and is preferably categorized in a plurality of different thickness groups. Thus, the distance that valve member 42 travels between upper and lower seats 50 and 51 is adjustable by choosing an appropriate thickness for valve lift spacer 44.

In order to reduce the influence of fluid flow forces on the movement of valve member 42, high pressure passage 40 and low pressure passage 41 preferably include flow restrictions that are restrictive relative to a flow area across respective seats 50 and 51. While these flow restrictions could be located in upper seat component 43 and/or lower seat component 45, they are preferably located in valve lift spacer 44 as shown in FIG. 2. In particular, the flow characteristics through high pressure passage 40 can be relatively tightly controlled by including a cylindrical segment 47 having a predetermined length and flow area. Furthermore, cylindrical segment 47 is relatively restrictive to flow relative to that across upper seat 50. Those skilled in the art will appreciate that it is easier to control and consistently machine a flow characteristic via a cylindrical segment as opposed to attempting to consistently control a flow area between stationary seat component and moveable valve member 42. Likewise, low pressure passage 41 preferably includes a cylindrical segment 48 that is located in valve lift spacer 44. In order to differentiate the rate at which pressure changes can occur in needle control chamber 37, cylindrical segment 48 preferably has a different flow area relative to cylindrical segment 47. This feature is present in the illustrated example as a strategy by which the opening rate of the direct control needle valve is slowed relative to the closure rate of the same. In other words, when direct control needle valve 11 lifts toward its open position, fluid is displaced from needle control chamber 37 through the flow restriction defined by cylindrical segment 48. When direct control needle valve 11 is closed, high pressure fluid flows into needle control chamber 37 from high pressure passage 40 through the flow restriction defined by cylindrical segment 47. Since cylindrical segment 48 has a smaller flow area than cylindrical segment 47, in the illustrated embodiment, the opening rate of direct control needle valve 11 can be made slower than its closure rate, which is often desired.

Figure 6:
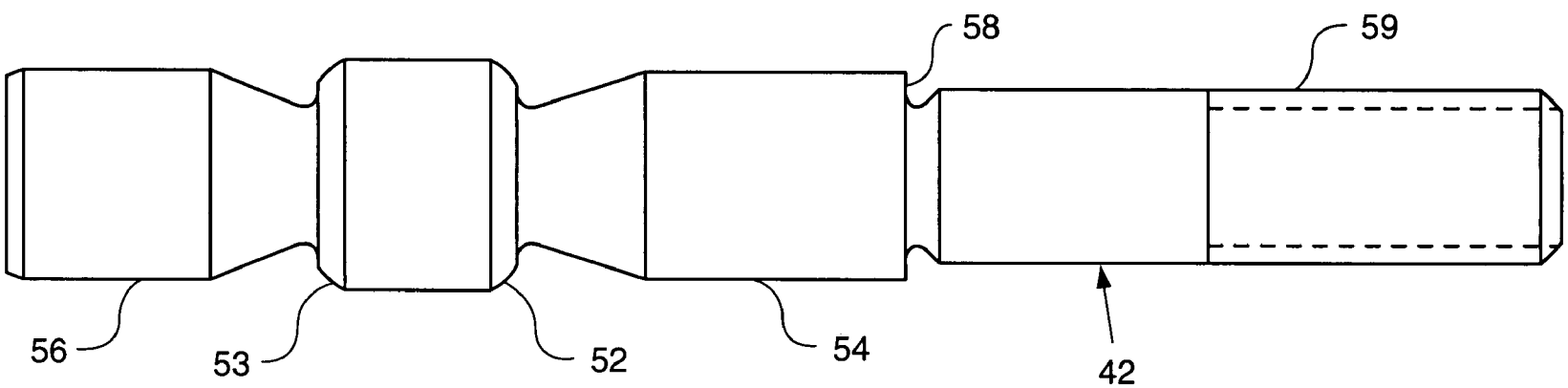
FIG. 6 is a side diagrammatic view of the valve member for the three way valve of FIGS. 4 and 5.

In order to accommodate for the possibility of a slight angular misalignment between the centerline of valve member 42 and the respective centerlines of upper and lower seats 50 and 51, valve member 42 preferably includes spherical valve surfaces 52 and 53, which have a common center as shown in FIG. 6. Those skilled in the art will appreciate that spherical valve seats 52 and 53 can contact and close valve seats 50 and 51 even in the event of some minor angular misalignment between valve member 42 and its respective seats. In order to insure that the respective passageways, such as nozzle supply passage 24, provide the proper fluid connection as shown in FIG. 2, the stationary components of three way valve 15 preferably include dowel bores 86 and 87 (FIG. 4), which are present to prevent the valve from being misassembled. In order to hold three way valve 15 together, it preferably includes a plurality of fasteners 46 that are threadably received in fastener bores 49 located in upper seat component 43. Nevertheless, those skilled in the art will appreciate that numerous other strategies could be employed for clamping three way valve 15 together.

Although piston 32 could be located in a common body as lower seat component 45, it is preferably separated from the same by a relatively thin separator 75 and housed in its own piston guide body 76, as shown in FIGS. 1 and 2.

Figure 7:
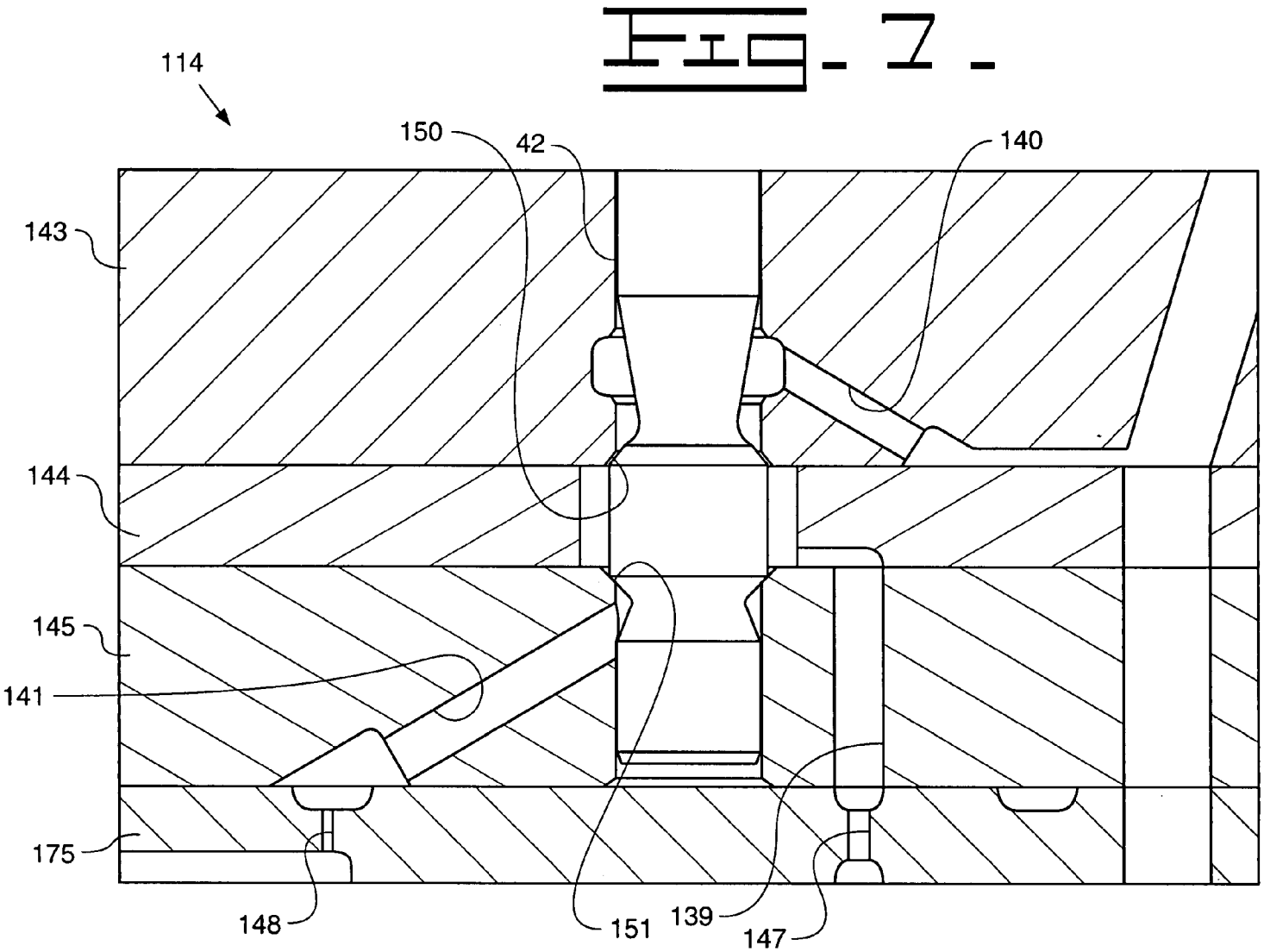
FIG. 7 is a sectioned side diagrammatic view of the three way valve according to another aspect of the invention.

Referring now to FIG. 7, a three way valve 114 according to another aspect of the present invention is similar to the three way valve previously described except that cylinder passage segments 147 and 148 have been relocated. In particular, like the earlier embodiment, three way valve 114 includes an upper seat component 143 separated from a lower seat component 145 by a valve lift spacer that determines the travel distance of valve member 42 between high pressure seat 150 and low pressure seat 151. When valve member 42 is in contact with low pressure seat 151, control passage 39 is fluidly connected to high pressure passage 140 across high pressure seat 150. When valve member 42 is in its upward position closing high pressure seat 150, needle control passage 139 is fluidly connected to low pressure passage 141 across low pressure seat 151. When fluid flows from high pressure passage 140 into control pressure passage 139, cylindrical passage segment 147 restricts fluid flow to needle control chamber 37 (FIG. 1). As in the previous aspect, cylindrical passage segment 147 is restrictive relative to flow across high pressure seat 150.

When needle valve member 42 is in its upward position closing high pressure seat 150, fluid can flow from needle control chamber 37 (FIG. 1) into low pressure passage 141 across low pressure seat 151. In this case, low pressure passage 141 includes a cylindrical passage segment 148, which performs in much the similar manner as the cylindrical segment 48 described in the earlier three way valve 14. In other words, cylindrical passage segment 148 is restrictive to flow relative to a flow area across low pressure seat 151. It should be noted that both cylindrical passage segment 147 and cylindrical passage segment 148 have been relocated from the valve lift spacer of the three way valve 14 described earlier to the needle stop plate 175, which need not be a category part. Thus, the issues involving valve lift spacer 144 being a category part can be separated from the need to closely control the flow areas through cylindrical passage segments 147 and 148. The three way valve 114 could be substituted in place of the valve 14 shown in the earlier Figures. Three way valve 114 may also exhibit an advantage over the three way valve 14 described earlier. In particular, it may be subject to lower amounts of leakage. In particular, leakage of high pressure fuel into low pressure passage 141 along the top and bottom surfaces of valve lift spacer 144 is believed to be reduced by relocating low pressure passage 141 into lower seat component 145 and plate stop component 175.

Figure 8:
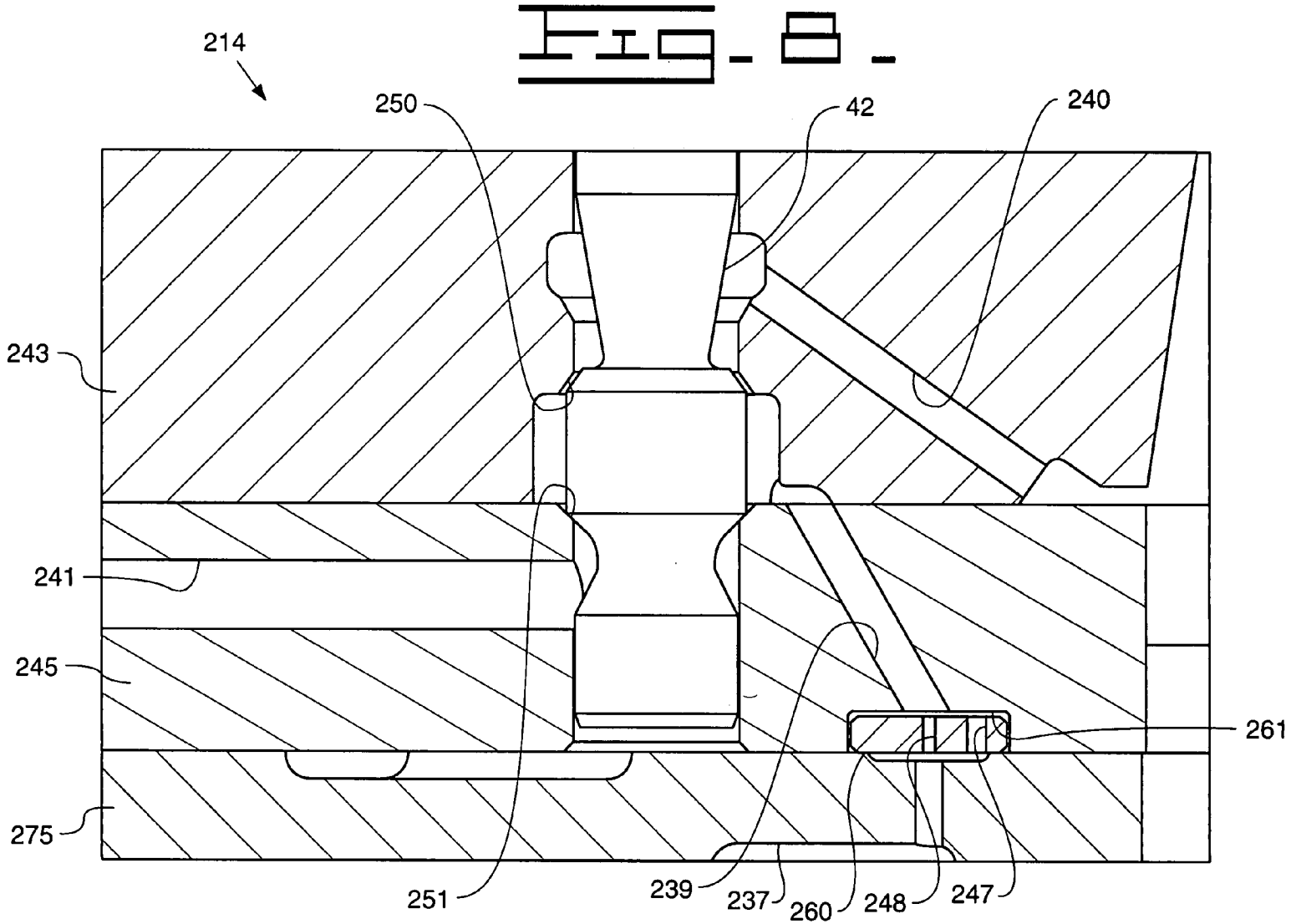
FIG. 8 is a sectioned side diagrammatic view of a three way valve according to still another aspect of the invention.

Referring now to FIG. 8, a three way valve 214 according to still another aspect of the present invention is similar to those previously described, except that flow to and from needle control chamber 237 is restricted relative to flow areas across high pressure seat 250 and low pressure seat 251 via an orifice plate 260 located in needle control passage 239. Like the earlier versions, valve member 42 is trapped to move between a high pressure seat 250 located in an upper seat component 243 and a lower seat component 251 located in lower seat component 245. When valve member 42 is in contact closing low pressure seat 251, high pressure passage 240 is fluidly connected to needle control chamber 237 past high pressure seat 250 and through cylindrical passage segments 247 and 248. In this embodiment, the total flow area through cylindrical segments 247 and 248 is restrictive relative to a flow area across high pressure seat 250, so that this version of the three way valve behaves in much the same manner as the previously described embodiments. When valve member 42 is in its upward position closing high pressure seat 250, fluid can flow from needle control chamber 237 into low pressure passage 241 past low pressure seat 251. However, this fluid flow lifts orifice plate 260 up into contact with flat seat 261 to close cylindrical passage segment 247. Thus, after orifice plate 260 lifts up into contact with flat seat 261, flow of fluid from needle control chamber 237 is restricted only to cylindrical passage segment 248, which is restrictive relative to a flow area across low pressure seat 251. When in its lower position, orifice plate 260 rests atop needle stop 275. This embodiment differs from the previous embodiments in that it does not include a valve lift spacer. Instead, the surfaces that include high pressure seat 250 and low pressure seat 251 are preferably contoured in a way that the valve travel distance can be controlled to an acceptable tolerance. Alternatively, one of the upper seat component 243 and the lower seat component 245 could be a category part. In still another alternative, each upper seat component 243 could be matched with a separate lower seat component 245 that provides for an acceptable valve travel distance. All three valves according to the present invention could perform in much of a similar manner.

INDUSTRIAL APPLICABILITY

The present invention finds potential application in any valve whose performance characteristics must be relatively tightly controlled while at the same time providing a structure that permits mass production and consistent performance from one valve to another. In addition, the present invention preferably finds particular application in the case of high speed valves that are required to accommodate relatively low flow volumes, such as pressure control valves employed in fuel injection systems.

When fuel injector 10 is in operation, electro-hydraulic actuator 12 works in conjunction with direct control needle valve 11 to control both timing and quantity of each injection event. Each injection event is initialized by raising fuel pressure in high pressure source 18 to injection levels. In some systems, this is accomplished by maintaining a common rail at some desired pressure. Alternatively, source 18 can be a fuel pressurization chamber within a unit injector which is pressurized when a plunger is driven downward, which is usually accomplished with a cam or a hydraulic force. Because valve member 42 is biased downward to close low pressure seat 51, direct control needle valve 11 will stay in its downward closed position due to the high pressure force acting on closing hydraulic surface 33 of piston portion 32. Shortly before the timing at which the injection event is desired to start, electrical actuator 16 is preferably energized by supplying an excessive current to coil 60. Because the speed at which electrical actuator 16 operates is related to the current level supplied to coil 60, one preferably supplies the maximum available current, which can be substantially higher than an amount of current necessary to cause the armature to move against the action of the spring bias. When sufficient magnetic flux builds, armature 62 and valve member 42 are pulled upwards until spherical valve surface 52 contacts upper or high pressure seat 50, 150, 250. When this occurs, needle control chamber 37 is fluidly connected to low pressure fuel reservoir 20 via low pressure passage 41, 141, 241. In order for direct control needle valve 11 to lift to its upward open position, fluid must be displaced from needle control chamber 37 toward low pressure reservoir 20. The rate at which direct control needle valve 11 opens is slowed by restricting this flow through cylindrical segment 48, 148, 248. This aids in allowing fuel injector 10 to produce some rate shaping. Shortly before the desired end of an injection event, current to electrical actuator 16 is reduced or terminated to a level that allows spring 67 to push armature 62 and valve member 42 downward until spherical seat 53 comes in contact with low pressure seat 51, 151, 251. When this occurs, high pressure fluid originating in nozzle supply passage 24 flows through high pressure passage 40, 140, 240 past high pressure seat 50, 150, 250 and into needle control chamber 37. The rate at which pressure builds in needle control chamber 37 and hence the response time from when current is terminated until direct control needle valve 11 moves toward its closed position can be influenced by appropriately sizing cylindrical segment 47, 147, or the combined flow area of cylindrical segments 247 and 248.

In order to produce fuel injectors 10 that behave consistently, the present invention preferably includes a structure for three way valve 15 that alleviates some of the problems that have plagued past valves. By including flow restrictions (cylindrical segments 47, 147, 247 and 48, 148, 248) away from valve seats 50, 150, 250 and 51, 151, 251, respectively fluid flow forces that can interfere with movement of the valve member 42 are reduced since the pressure differentials often associated with valves are moved away from the valve seats. Furthermore, by locating these flow restrictions in the valve lift spacer 44 (FIGS. 1–5), stop plate 175 (FIG. 7) or orifice plate 260 (FIG. 8), the flow restrictions can be more easily manufactured, and permits valve opening and closing pressure control to be set somewhat independently. This same strategy allows more consistency in performance among valves since their performance is desensitized from the flow areas across the respective seats of the valves which will likely be different from one valve to another due at least in part to the fact that each component has geometrical tolerances that render them realistically manufacturable. Because the cylindrical segments formed in the valve lift spacers can be made with great consistency, the behavior of the respective valves can be made more consistent.

Another feature of the three way valve 15 of the present invention that can provide for more consistent performance includes the use of a valve lift spacer as a category part. In other words, in order for consistency to be maintained, the valve travel distance from one valve to another should be made as consistent as possible. In the case of the present valve, this is accomplished by choosing a valve lift spacer for each individual valve with a thickness that results in a relatively uniform travel distance from one valve to another. In other words, each valve should have relatively uniform travel distances, but this is accomplished by employing valve lift spacers of a variety of thicknesses in each of the different valves. In the case of the present invention, the valve travel distance is preferably on the order of about 30 microns, or between 25 and 35 microns. In any event, the strategy of the present invention can be employed to reliably produce valves with consistent lifts less than about 50 microns. This is accomplished by grouping valve lift spacers in a plurality of different thickness groups. Preferably, each of these groups contain valve lift spacers of a specific predetermined thickness plus or minus about three microns.

Another strategy employed by the present invention in order to improve response time includes defining the needle control chamber, which is referred to in the claims as the "third passage", at least in part with volume reducing features. Ordinarily, this will be accomplished by paying attention to machining the various components that make up needle control chamber 37 in order to reduce its volume. By reducing its volume, it can respond to pressure changes more quickly. For instance, in the present invention, this strategy is employed, for example, by making the vertical portion of needle control chamber 37 only extend a portion of the way into valve lift spacer 44. Thus, the top surface of this segment could be considered a volume reducing surface feature.

Those skilled in the art will appreciate that leakage through the valve, especially during fuel injection events, is generally undesirable. Fluid leakage is generally reduced by relying upon a three way valve as in the present invention instead of a two way valve that relies upon leakage to produce its pressure changes as in some other known needle control strategies. In addition, the embodiments of FIGS. 7 and 8 seek to further reduce potential leakage through the three way valve by moving the low pressure passage away from the valve. Those skilled in the art will appreciate that the pressure differentials in the three way valve can be extremely high during a fuel injection event. This pressure acts to push the upper seat component away from the lower seat component, and fluid will tend to migrate in the area especially on the upper and lower surfaces of the valve lift spacer. By locating the low pressure passage away from this area, these embodiments may exhibit better performance with regard to reducing leakage. Reducing leakage can generally improve the reliability and predictability of the fuel injection quantity. Since a fuel injection quantity is often defined by the control valve on time duration, any fuel that leaks past the valve can necessarily reduce the amount of fuel actually injected below a predicted amount.

Those skilled in the art will appreciate that that various modifications could be made to the illustrated embodiment without departing from the intended scope of the present invention. For instance, the third passage (needle control chamber 37) need not necessarily be a closed volume in another application of the present invention. Thus, those skilled in the art will appreciate the other aspects, objects and advantages of this invention can be obtained from a study of the drawings, the disclosure and the appended claims.

What is claimed is:

1. A three way valve comprising:

a valve body having a first passage, a second passage and a third passage disposed therein, and including a first seat and a second seat;

a valve member at least partially positioned in said valve body, and being moveable between said first seat and said second seat;

said first passage being open to said third passage across said first seat when said valve member is in contact with said second seat;

said second passage being open to said third passage across said second seat when said valve member is in contact with said first seat; and at least one of said first passage, said second passage and said third passage including a flow restriction relative to a flow area across at least one of said first seat and said second seat.

2. The valve of claim 1 wherein one of said first passage and said third passage has a first flow restriction relative to a flow area across said first seat; and one of said second passage and said third passage has a second flow restriction relative to a flow area across said second seat.

3. The valve of claim 2 wherein said first flow restriction includes a cylindrical passage segment; and said second flow restriction includes a cylindrical passage segment.

4. The valve of claim 2 wherein said first flow restriction has a smaller flow area than said second flow restriction.

5. The valve of claim 1 including an electrical actuator with a moveable portion attached to said valve member; and a spacer having a predetermined one of a plurality of thicknesses.

6. The valve of claim 5 wherein said moveable portion includes an armature, and a stationary portion includes a stator; and said armature having an air gap relative to said stator defined by a thickness of said spacer.

7. The valve of claim 5 wherein said electrical actuator includes a male/female electrical socket connector.

8. The valve of claim 5 including a biaser operably positioned to bias said valve member toward said first seat.

9. The valve of claim 1 wherein said third passage is a portion of a closed volume.

10. The valve of claim 9 wherein said closed volume is at least partially defined by at least one volume reducing surface feature.

11. The valve of claim 1 wherein said valve body includes an unobstructed flow passage therethrough; and said second passage is fluidly connected to said flow passage.

12. The valve of claim 1 wherein a travel distance of said valve member between said first seat and said second seat is less than 50 microns.

13. The valve of claim 12 wherein said travel distance is between 25 and 35 microns.

14. The valve of claim 1 wherein said valve body includes a lift spacer separating a first seat component and a second seat component;

a travel distance of said valve member between said first seat and said second seat being defined by a thickness of said lift spacer; and said lift spacer has a predetermined one of a plurality of thicknesses.

15. The valve of claim 1 wherein said valve member has a separate guide clearance with each of a first seat component and a second seat component.

16. The valve of claim 1 wherein said valve member has a pair of spherical valve surfaces with a common center.

17. An electro-hydraulic actuator comprising a source of high pressure liquid;

a low pressure liquid reservoir;

a three way control valve with a high pressure passage fluidly connected to said source of high pressure liquid, a low pressure passage fluidly connected to said low pressure liquid reservoir, and including a closed control pressure volume and a valve member trapped to move between a high pressure seat and a low pressure seat, and said closed control pressure volume including a control passage;

a moveable piston with a control hydraulic surface exposed to fluid pressure in said control pressure volume;

an electrical actuator operably coupled to said valve member;

said low pressure passage being open to said control pressure volume across said low pressure seat when said valve member is in contact with said high pressure seat; and said high pressure passage being open to said control pressure volume across said high pressure seat when said valve member is in contact with said low pressure seat; and at least one of said high pressure passage, said low pressure passage and said control passage including a flow restriction relative to a flow area across one of said low pressure seat and said high pressure seat.

18. The actuator of claim 17 wherein one of said low pressure passage and said control passage has a first flow restriction relative to a flow area across said low pressure seat; and one of said high pressure passage and said control passage has a second flow restriction relative to a flow area across said high pressure seat.

19. The actuator of claim 18 wherein said closed control pressure volume is at least partially defined by at least one volume reducing surface feature.

20. The actuator of claim 19 wherein said first flow restriction includes a cylindrical passage segment; and said second flow restriction includes a cylindrical passage segment.

21. The actuator of claim 20 wherein said three way valve includes a lift spacer separating an upper seat component and a lower seat component;

a travel distance of said valve member between said low pressure seat and said high pressure seat being defined by a thickness of said lift spacer; and said lift spacer has a predetermined one of a plurality of thicknesses.

22. The actuator of claim 21 wherein said electrical actuator includes an armature attached to said valve member; and a stator separated from said armature by an air gap defined by a spacer, which has a predetermined one of a plurality of thicknesses.

23. The actuator of claim 22 including a biaser operably coupled to bias said valve member toward contact with one of said high pressure seat and said low pressure seat.

24. The actuator of claim 23 wherein said first flow restriction has a smaller flow area than said second flow restriction.

25. The actuator of claim 24 wherein said valve member has a separate guide clearance with each of said upper seat component and said lower seat component.

26. The actuator of claim 25 wherein said electrical actuator includes a male/female electrical socket connector.

27. The actuator of claim 26 wherein said piston is a portion of a member that includes an opposing hydraulic surface, which is exposed to fluid pressure in said high pressure passage, in opposition to said control hydraulic surface.

28. The actuator of claim 27 wherein said member is moveable between a first position and a second position; and a biaser operably positioned to bias said member toward one of said first position and said second position.

29. A method of operating a three way control valve, comprising the steps of:

fluidly connecting a first passage to a third passage across a second valve seat at least in part by positioning a valve member in contact with a first seat;

restricting liquid flow from said third passage to said first passage at least in part by locating a first flow restriction in at least one of said first passage and said third passage, wherein said first flow restriction is restrictive relative to a flow area across said second seat;

fluidly connecting a second passage to said third passage across said first seat at least in part by moving said valve member into contact with said second seat;

restricting liquid flow from said second passage to said third passage at least in part by locating a second flow restriction in at least one of said second passage and said third passage, wherein said second flow restriction is relative to a flow area across said first seat.

30. The method of claim 29 including a step of hastening pressure changes in said third passage at least in part by defining said third passage with at least one volume reducing surface feature.

31. The method of claim 30 including a step of differentiating flow rates through the valve at least in part by making said first flow restriction more restrictive than said second flow restriction.

32. The method of claim 31 including a step of reducing a valve response time at least in part by supplying excessive power to an electrical actuator attached to said valve member.

33. The method of claim 32 including a step of reducing leakage at least in part by blocking said second passage to said third passage when said valve member is in contact with said first seat; and blocking said first passage to said third passage when said valve member is in contact with said second seat.

* * * * *